US006267562B1

(12) United States Patent
Hirota

(10) Patent No.: US 6,267,562 B1
(45) Date of Patent: Jul. 31, 2001

(54) VARIABLE DISPLACEMENT COMPRESSOR

(75) Inventor: Hisatoshi Hirota, Tokyo (JP)

(73) Assignee: TGK Co., Ltd., Tokyo (JP)

( * ) Notice: Subject to any disclaimer, the term of this patent is extended or adjusted under 35 U.S.C. 154(b) by 0 days.

(21) Appl. No.: 09/411,293

(22) Filed: Oct. 4, 1999

(30) Foreign Application Priority Data

Nov. 11, 1998 (JP) ..... 10-320391

(51) Int. Cl.[7] ..... F04B 1/26
(52) U.S. Cl. ..... 417/222.2
(58) Field of Search ..... 417/222.1, 222.2

(56) References Cited

U.S. PATENT DOCUMENTS

Re. 35,672 * 11/1997 Taguchi ..... 417/222.2
4,428,718 * 1/1984 Skinner ..... 417/222.2
4,687,419 * 8/1987 Suzuki et al. ..... 417/222.2
4,752,189 * 6/1988 Bearint et al. ..... 417/222.2
4,932,843 * 6/1990 Itoigawa et al. ..... 417/222.2
5,624,240 * 4/1997 Kawaguchi et al. ..... 417/222.2
5,681,150 * 10/1997 Kawaguchi et al. ..... 417/222.2
5,741,122 * 4/1998 Yokono et al. ..... 417/222.2
5,785,502 * 7/1998 Ota et al. ..... 417/222.2
6,102,670 * 8/2000 Taguchi ..... 417/222.2
6,158,970 * 12/2000 Ota et al. ..... 417/222.2
6,164,926 * 12/2000 Kawaguchi ..... 417/222.2

* cited by examiner

*Primary Examiner*—Teresa Walberg
*Assistant Examiner*—Leonid Fastovsky
(74) *Attorney, Agent, or Firm*—Nilles & Nilles, S.C.

(57) ABSTRACT

At the suction side of a variable displacement compressor a valve structure is provided which either responds to a relative differential pressure value or a relative pressure value or a relative temperature value of the refrigerant processed by the variable displacement compressor such that in case of small load and a minimum operation state of the compressor the suction side will be cut-off or in case of large load and simultaneous minimum operation state of the compressor will not be cut-off. The valve structure automatically decides and responds to parameter changes representing in case of the minimum operation state of the compressor a large load or a small load, in order to avoid freezing of the fins of the evaporator in case of small load and to improve the fuel efficiency of the engine driving the compressor in case of large load.

16 Claims, 9 Drawing Sheets

VARIABLE DISPLACEMENT COMPRESSOR

BACKGROUND OF THE INVENTION

1. Field of the Invention

The present invention relates to a variable displacement compressor used for compressing refrigerant in a refrigeration cycle of an automobile air conditioner or the like, comprising an airtight crank chamber and a variable inclination angle swing body installed on an axis of rotation inside said crank chamber, comprising at least one piston reciprocally guided in a cylinder and connected to said swing body, said cylinder being selectively connectable to a suction chamber in turn connected to a low-pressure refrigerant pipe conduit or to a discharge chamber in turn connected to a low-pressure refrigerant pipe conduit, and means in said variable displacement compressor for varying the amount of discharge of said refrigerant into said discharge chamber between a minimum discharge amount in a minimum operation state of the compressor and a maximum discharge amount by varying the angle of inclination of said swing body corresponding to a change of a pressure within said crank chamber, and further comprising a main valve between said low-pressure refrigerant pipe conduit and said suction chamber, said main valve being actuable between a fully closed state and a fully opened state.

2. Description of the Related Art

As the compressor used in a refrigeration cycle of an automobile air conditioner has a belt directly connected to the engine by a transmission belt, the number of its rotations cannot be controlled independently from engine speed. So a variable displacement compressor is used which can change the amount of refrigerant (the amount of discharge) to obtain the appropriate cooling capacity without being restricted by the number of rotations of the engine. In such a variable displacement compressor, a swing plate is generally installed in an airtight crank chamber so as to be able to tilt over a variable angle of inclination. The swing plate is driven by rotational movement of the axis of rotation and executes swing movements. A piston executing reciprocal motions by the swing movements of the swing plate sucks refrigerant of a suction chamber connected to a low-pressure refrigerant pipe conduit into a cylinder, compresses it, and discharges it to a discharge chamber connected to a high-pressure refrigerant pipe conduit. The amount of discharge of the refrigerant is changed by changing the angle of inclination of the swing plate according to change of pressure of the crank chamber. The variable displacement compressor used for a refrigeration cycle of an automobile air conditioner generally continues to operate even when cooling capacity is not needed, with a minimum displacement which is about 5% of the maximum displacement. That is, the compressor then operates at the minimum operation state. However, if simply operated like that, the problem occurs that even at the minimum operation state fins of the evaporator freeze when the load is small as in winter, due to a flow of compressed refrigerant into the evaporator. So, a valve is installed to enable a passage between the low-pressure refrigerant pipe conduit and the suction chamber to be fully closed, thereby preventing the low-pressure refrigerant from being sucked into the compressor at the minimum operation state. The conventional variable displacement compressor used in a refrigeration cycle of an automobile air conditioner makes the passage between the low-pressure refrigerant pipe conduit and the suction chamber to be fully closed at the minimum operation, irrespective of the season. However, freezing of the fins of the evaporator is a problem which occurs only when the load is small, as in winter. The problem of freezing does not occur, when the load is higher, as in summer. The load of the compressor for the engine produced by having closed the inlet of the compressor leads to a disadvantageous result because fuel efficiency decreases.

OBJECTS AND SUMMARY OF THE INVENTION

Therefore, the present invention aims to provide a variable displacement compressor with improved fuel efficiency which does not generate freezing of the fins of the evaporator at the minimum operation state, when the load is small, as in winter, and which reduces the load to the engine when the load is large, as in summer.

Said task can be achieved with a variable displacement compressor according to claim 1, claim 2, claim 3 or claim 4.

According to a first aspect of the invention a main valve actuating structure is provided, actuating the main valve by refrigerant pressure into its closed state, said main valve actuating means being responsive to a relative pressure condition or a relative temperature condition of the refrigerant in the low-pressure pipe conduit, said relative pressure condition or relative temperature condition representing during said minimum operation state of said compressor a small load condition.

Since said main valve actuating structure is responsive to a relative pressure condition or a relative temperature condition of the refrigerant in the low-pressure pipe conduit which condition is representing either a small load condition and simultaneously said minimum operation state of the compressor or a large load condition, the main valve automatically is brought into a fully closed state only in case of a small load condition and simultaneously with a minimum operation state of the compressor. This means that in case of higher load conditions as in summer and during a minimum operation state of the compressor with the not fully closed main valve the power consumption of the compressor is low, improving the fuel efficiency of the engine driving the compressor. This is based on the recognition that in a large load condition as in summer there is no danger of fin freezing even though the compressor supplies a small amount of refrigerant to the evaporator. Operation of the compressor with fully closed main valve occurs only in case of a small load condition during the minimum operation state of the compressor and to the benefit of the elimination of the danger of fin freezing, e.g. as in winter with low ambient temperature.

According to a further aspect of the invention as said main valve a differential-pressure sensing open and close valve is provided which opens and closes respectively when a differential pressure Pd minus Pe between the pressure Pd of the refrigerant in said discharge chamber and the pressure of the refrigerant in said low-pressure refrigerant pipe conduit is larger or smaller than a predetermined differential pressure value.

According to a further aspect of the invention as a main valve a temperature sensing open and close valve for low-pressure refrigerant is provided between said low-pressure refrigerant pipe conduit and said suction chamber which opens and closes respectively when the temperature of the refrigerant in said suction chamber and/or in said low-pressure pipe conduit is higher or lower than a predetermined temperature value.

According to a further aspect of the invention as a main valve a pressure sensing open and close valve for low-pressure refrigerant is provided between the low-pressure refrigerant pipe conduit and said suction chamber which opens and closes respectively when the pressure of the refrigerant in said low-pressure refrigerant pipe conduit is lower or higher than a predetermined pressure value.

The present invention enables the inlet of a variable displacement compressor used in a refrigeration cycle of an automobile air conditioner automatically to be closed when the load is small and opened when the load is large. So, freezing of fins of an evaporator can be avoided at the minimum operation state with a small load for the engine, as in winter, and the fuel efficiency can be improved by reducing the load for the engine when the load is large, as in summer.

A refrigerant reflux conduit connecting the discharge chamber and the low-pressure refrigerant pipe conduit with a small cross-sectional area and only when the main valve is closed allows by a backflow of refrigerant to keep the pressure in the low-pressure refrigerant pipe conduit on a level which is not too much below the predetermined pressure value as long as the main valve is closed.

When the closure member of the main valve is connected to an actuating piston member provided in a driving chamber communicating via a drive line with said discharge chamber, the pressure of the refrigerant in the system can be used to actuate the main valve accordingly. The pressure in the discharge chamber has the function of a pilot pressure mainly for adjusting and maintaining the main valve closed position.

In order to avoid undesirable pressure forces on the main valve displacement structure said structure ought to be pressure balanced either with respect to the pressure in the low-pressure pipe conduit or to the pressure in the suction chamber.

If the differential pressure used to actuate the main valve is derived from the pressure in the discharge chamber and the pressure in the low-pressure pipe conduit said differential pressure ought to be active in parallel to the force of a main valve closing spring which determines the differential pressure value at which the main valve will be closed.

If, alternatively, the relative differential pressure used to actuate the main valve is derived from the discharge chamber pressure and the suction chamber pressure, said differential pressure ought to be active in closing direction of the main valve and counter to the force of a weak valve opening spring.

In order to allow a backflow of refrigerant from said driving chamber into said low-pressure pipe conduit to control the pressure in the low-pressure pipe conduit accordingly, a valve structure in said reflux conduit exclusively opens when the main valve is closed. This easily can be controlled in strict dependence from the stroke position of said piston member actuating the closure member of the main valve. By said measure a backflow of refrigerant is blocked whenever the main valve is in an open state.

In case that the valve structure in the drive line is connected to a temperature responsive drive member contacted by the refrigerant in the low-pressure pipe conduit the temperature of the refrigerant can be sensed reliably in order to shift the main valve into the closed state in case that the temperature value represents a small load condition and simultaneously a minimum operation state of the compressor.

For that purpose a flexible bimetallic drive member which optionally is spring-loaded in both flexing directions to perform a bi-stable performance is advantageous.

Alternatively the valve structure contained in the drive line can be connected to a pressure responsive drive member responding to the pressure of the refrigerant in the low-pressure pipe conduit in order to bring said valve structure into an open state and to reliably close the main valve, in case that the pressure of the refrigerant is representing a small load condition and simultaneously the minimum operation state of the compressor.

For this purpose a diaphragm is of advantage which is contacted by the refrigerant in closing direction of said valve structure and is loaded on the opposite side by a reference pressure like the atmospheric pressure.

It is advantageous to have a bleeding channel connecting the suction chamber and said driving chamber and a flow restrictor within said bleeding channel allowing a restricted communication for the refrigerant.

If the reflux conduit is connecting said driving chamber and said low-pressure pipe conduit, said reflux conduit ought to be blocked in the open state of the main valve and only ought to be open in the closed state of the main valve in order to control the pressure in the low-pressure pipe conduit.

In any case the main valve in its closed state could allow a flow of refrigerant towards the suction chamber just sufficient to provide the necessary lubrication for the compressor by this leaking refrigerant amount. However, said leaking amount ought to be limited such that in case of low load fin freezing of the evaporator is suppressed reliably.

BRIEF DESCRIPTION OF THE DRAWINGS

Embodiments of the invention will be described with the help of the drawing. In the drawing is.

DESCRIPTION OF THE PREFERRED EMBODIMENTS

Figure 2:
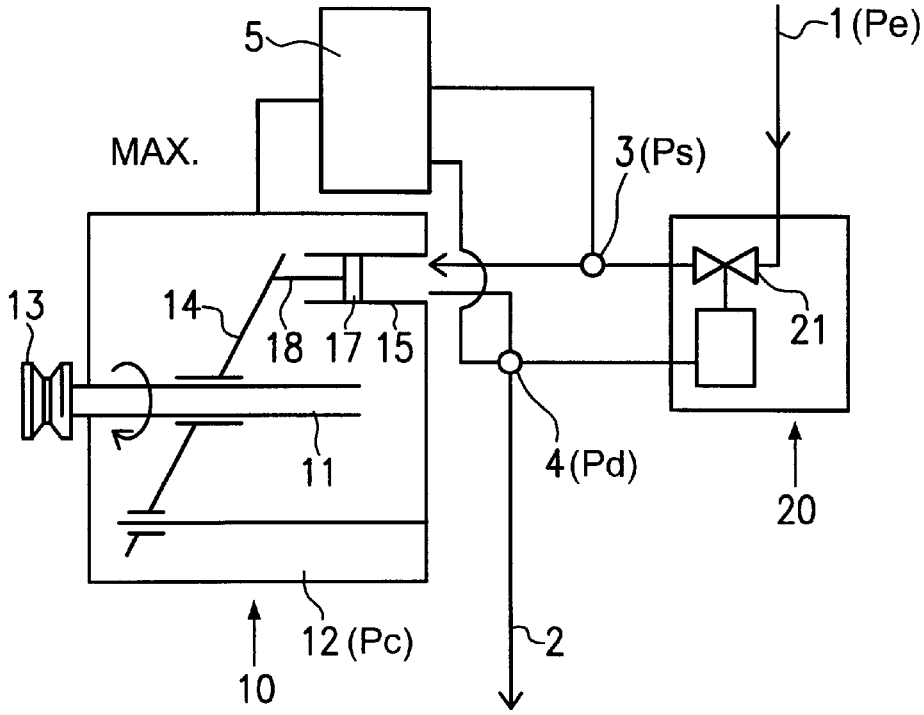
Figure 3:
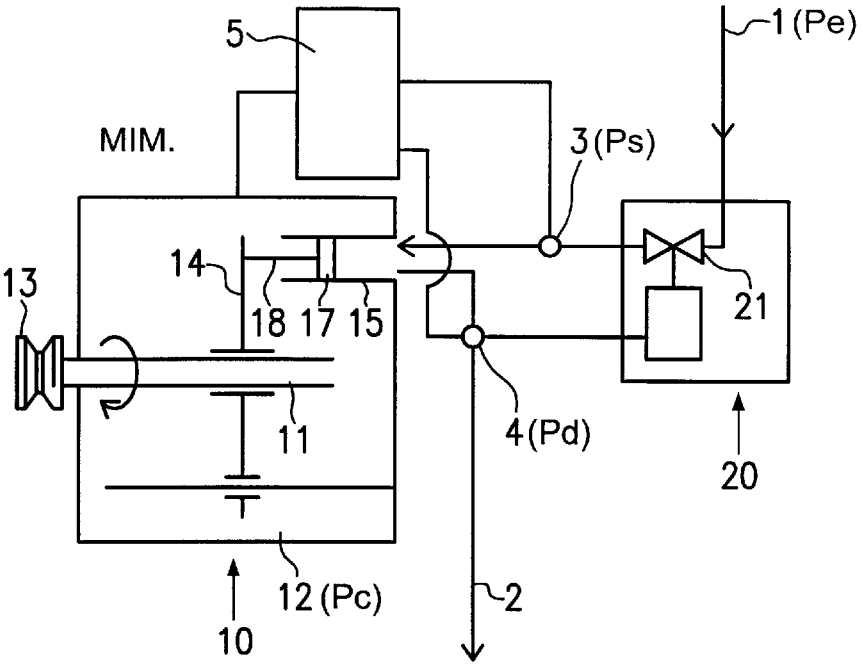

In FIGS. 2 and 3 a variable displacement compressor 10 is shown used in a refrigeration cycle of an automobile air conditioner. The compressor 10 includes an airtight crank chamber 12 containing an axis 11 of rotation driven by a driving pulley 13. A swing plate 14 within crank chamber 12 is tilted with respect to the axis 11 of rotation and swings in accordance with a rotation of the axis of rotation 11. A cylinder 15 provided e.g. in crank chamber 12 receives a reciprocal piston 17 in a peripheral part of the crank chamber 12. A rod 18 connects pistons 17 and swing plate 14 with another. When the swing plate 14 swings, the piston 17 executes reciprocal motions in the cylinder 15. Via, not shown, conventional valve means a suction chamber 3 and a discharge chamber 4 are connected to cylinder 15. Refrigerant is drawn into the cylinder 15 from suction chamber 3 arranged at the upstream side of cylinder 15, then is compressed in cylinder 15, and thereafter is discharged to discharge chamber 4 located at a downstream side.

Low-pressure refrigerant is supplied to suction chamber 3 from a low-pressure refrigerant pipe conduit 1 located upstream of suction chamber 3. High-pressure refrigerant is discharged from discharge chamber 4 to a high-pressure refrigerant pipe conduit 2 located downstream thereof. Pe is the pressure in the low-pressure refrigerant pipe conduit 1; Ps is the pressure in the suction chamber 3; Pd is the pressure of the refrigerant in the discharge chamber 4; and Pc is the pressure inside the crank chamber 12.

The angle of inclination of the swing plate 14 in relation to the axis 11 of rotation changes according to the pressure Pc. The amount of discharge of refrigerant from cylinder 15, i.e. the capacity of the compressor 10, changes by the angle of inclination of the swing plate 14. If a condition Pc equals Ps occurs, the state of the maximum displacement shown in FIG. 2 is achieved. If Pc is increasing, finally the state of the minimum displacement or the minimum operation state of the compressor 10 as shown in FIG. 3 is achieved.

A displacement control apparatus 5 controls displacement of the compressor 10 by automatically controlling the crank chamber pressure Pc in correspondence to a change of the suction chamber pressure Ps. Displacement control apparatus changes its control level electromagnetically.

A main valve 20 (FIGS. 1 to 4) is provided at the suction side of the compressor and is designed as a differential-pressure sensing open and close valve which opens and closes a passage between low-pressure refrigerant pipe conduit 1 and suction chamber 3 by means of a valve seat 22 and a valve closure member 21. Said main valve 20 is designed so that it does not close when the load is large as in summer and does close automatically only when the load is small as in winter, and when the variable displacement compressor is in its minimum operation state (FIG. 3).

Figure 1:
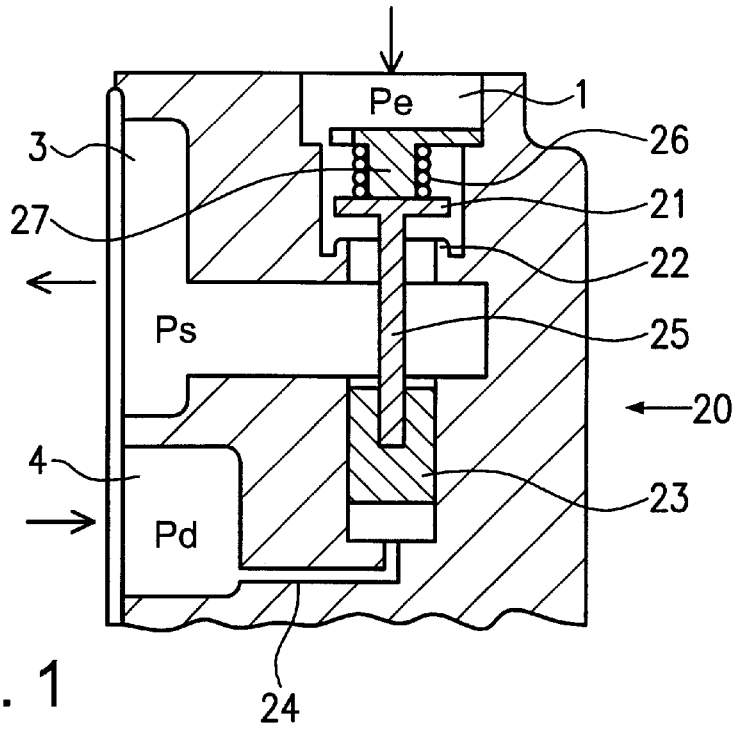
FIGS. 1 and 4 Sectional views of a first embodiment of a valve structure at the suction side of a variable displacement compressor, in an open state and in a closed state, respectively, FIGS. 2 and 4 A schematic block diagram of a variable displacement compressor containing the valve structure of FIGS. 1 and 3, illustrating the compressor in the maximum displacement state or the maximum operation state, and the minimum displacement state or minimum operation state, respectively, FIGS. 5 and 6 Sectional views of another embodiment of a valve structure for the variable displacement compressor, in an opened state and a fully closed state, respectively, FIGS. 7 and 8 Sectional views of a further embodiment of the valve structure for the variable displacement compressor, in a fully opened state and in a fully closed state, respectively, FIGS. 9 and 10 Sectional views of a further embodiment of a valve structure for the variable displacement compressor, in a fully opened and in a fully closed state, respectively, FIGS. 11 and 12 Sectional views of a further embodiment of a valve structure for the variable displacement compressor, in a fully opened and in a fully closed state, respectively, FIGS. 13 and 14 Sectional views of a further embodiment of a valve structure for the variable displacement compressor, in a fully opened and in a fully closed state, respectively, FIGS. 15 and 16 Sectional views of a further embodiment of a valve structure for the variable displacement compressor, in a fully opened and in a fully closed state, respectively, and FIG. 17 A sectional view of a further embodiment of a valve structure for the variable displacement compressor, in a fully opened and pressureless state.
Figure 4:
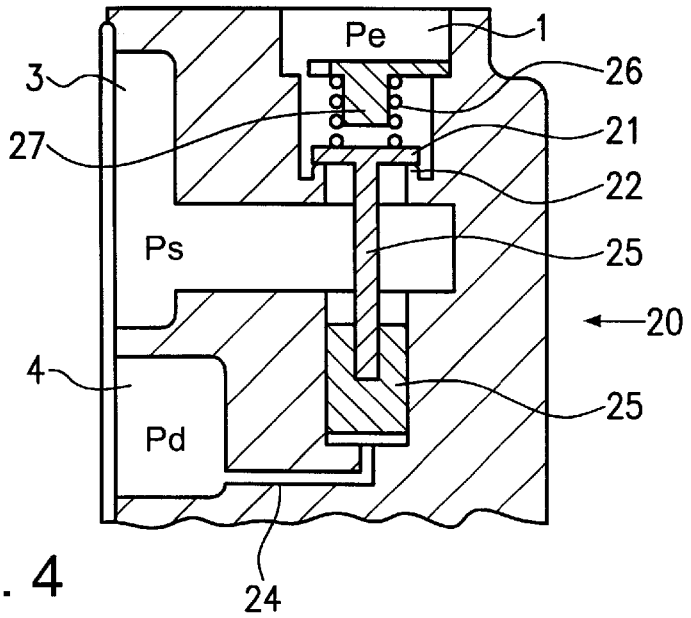

In FIGS. 1 and 4 said main valve 20 is designed as a differential-pressure sensing open and close valve according to a first embodiment. FIG. 1 is illustrating an open state when the load is large as in summer, while FIG. 4 is illustrating a closed state when the load is small as in winter.

Closure member 21 is provided opposing to valve seat 22 from the upstream side thereof. Valve seat 22 is arranged between low-pressure refrigerant pipe conduit 1 and suction chamber 3. A piston body 23 is integrally connected to closure member 21 by a connecting rod 25. Piston body 23 is provided in a driving chamber where pressure Pd of the discharge chamber 4 acts on the space at the rear side of piston body 23 via a driving high-pressure-side pipe 24.

The pressure receiving area of piston body 23 and the sectional area of valve seat 22 are essentially equal. For that reason the suction chamber pressure Ps between closure member 21 and piston body 23 is cancelled, i.e. is balanced, so that it does not create any displacement force on the actuating structure constituted by closure member 21 and piston body 23. A differential pressure (Pd minus Pe) between pressure Pd in the discharge chamber 4 and the pressure Pe in the low-pressure refrigerant pipe conduit 1 acts on the actuating structure formed by closure member 21 and piston body 23. A compression coil spring 26 defining a main valve closing spring acts on closure member 21 at the upstream side thereof. Compression coil spring 26 is seated at a fixed spring support 27 at the side of low-pressure refrigerant pipe conduit 1.

As a result, closure member 21 is lifted from valve seat 22 and falls into a valve open state (FIG. 1) when the value of the differential pressure (Pd minus Pe) between the pressure Pd of the discharge chamber 4 and the pressure Pe of the low-pressure refrigerant pipe conduit 1 becomes larger than the force of compression coil spring 26, such that the force of compression coil spring 26 determines the differential pressure value for opening and closing said main valve.

To the contrary, when the value of differential pressure Pd minus Pe is smaller than the force of compression coil spring 26 closure member 21 is pushed onto valve seat 22 and falls into a valve closed state (FIG. 4).

However, even in the valve-closed state a minimum amount of refrigerant should be allowed to pass through the main valve in order to cool and lubricate the variable displacement compressor 10, e.g. the closure function constituted between closure member 21 and valve seat 22 is intentionally formed so as to be imperfect. As an alternative, a leak hole may be provided in closure member 21 or across valve seat 22. Said measure allowing a minimum amount of refrigerant to pass through the closed main valve can be similarly applied to each following embodiment of the inventive valve structure.

If the value of the differential pressure Pd minus Pe with which the main valve 21, 22 changes between the open state and the closing state, or vice versa, is set to about 2 times the atmospheric pressure (approximately 2 Bar), for instance the main valve 21, 22 changes between its open state and its closed state in accordance with load. The passage between the low-pressure refrigerant pipe conduit 1 and the suction chamber 3 is closed when the load is small, e.g. as in winter, and is open when the load is large, e.g. as in summer.

If the load is small, no refrigerant is sucked into the variable displacement compressor 10 from the low-pressure conduit pipe 1. So freezing of the fins of the evaporator (not shown) can be avoided even when the compressor continues to operate at the minimum operation state. If, on the other hand, the load is large, an amount of refrigerant corresponding to the operation state is sucked into the variable displacement compressor 10 from the low-pressure conduit pipe 1 even at the minimum operation state of the compressor 10. As a consequence, superfluous load is not applied by the compressor 10 to the engine (not shown) driving the compressor and the fuel efficiency of the engine can be improved.

Figure 5:
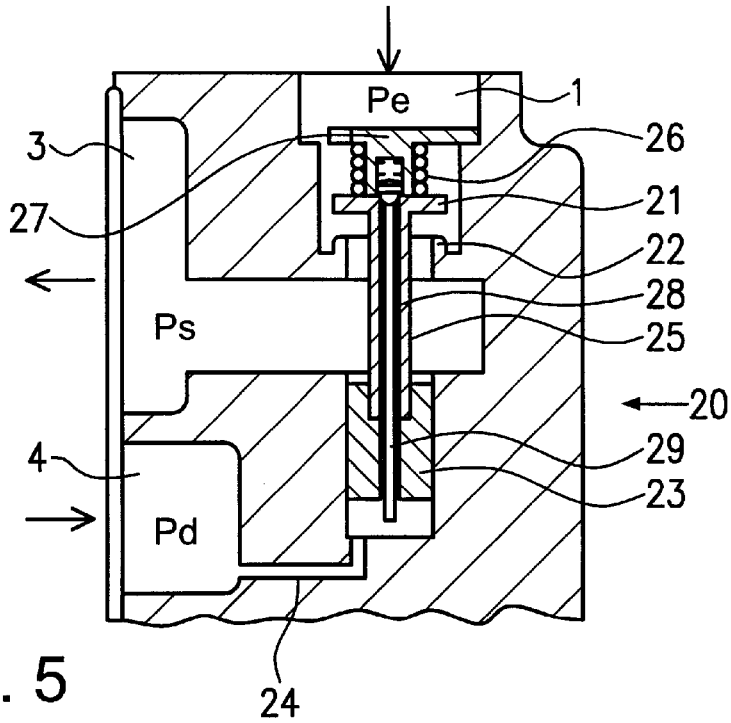
Figure 6:
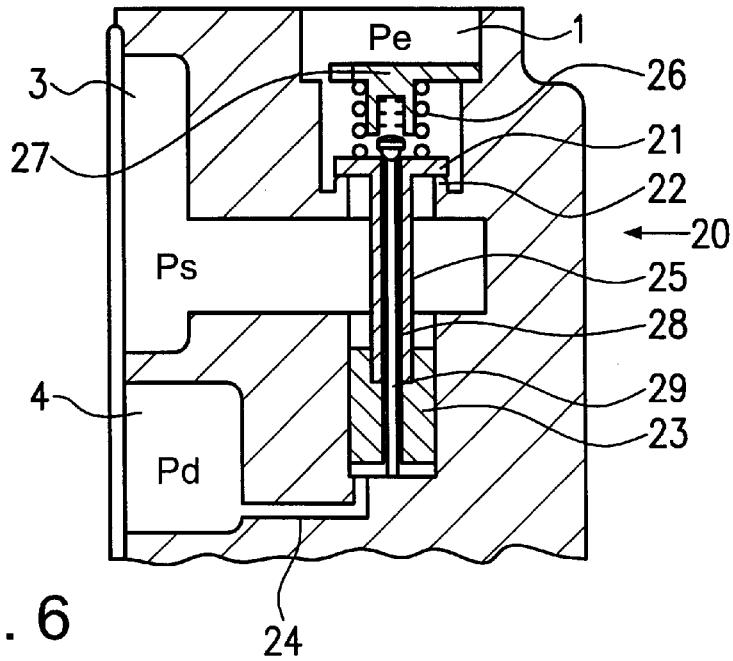

The structure of the embodiment of the main valve 20 of FIGS. 5 and 6 additionally is equipped with a refrigerant reflux conduit 28, e.g. at the position of the axis of connecting rod 25. Said conduit 28 allows to connect the driving chamber at the rear side of piston body 23 to be connected to the low-pressure refrigerant pipe conduit 1. A refrigerant reflux valve 29 is provided which closes the inlet of conduit 28 in case that main valve 21, 22 is in its open state. Valve 22 includes a rod loosely fitted into conduit 28 (a longitudinal channel in the interior of connecting rod 25) and a valve member seated in the top mouth of conduit 28. Spring support 27 is formed with a recess receiving the valve member and a weak valve closure spring in the open state of main valve 21, 22 (FIG. 5). The rod 25 can have a longitudinal extension such that it abuts on the bottom of drive chamber of piston body 23 when closure member 21 is seated on valve seat 22 in order to open refrigerant reflux valve 29 (FIG. 6). The flow of refrigerant through reflux conduit 28 is restricted when valve 29 is its open position (FIG. 6).

Via refrigerant reflux conduit 28 the pressure Pd in the discharge chamber 4 is transmitted to the low-pressure refrigerant pipe conduit 1 so that pressure Pe in the low-pressure pipe conduit 1 can be controlled so as not to be too much below a predetermined pressure value. However, not only the pressure is transmitted but also a reflux of a lubricant or lubricating refrigerant is executed.

Figure 7:
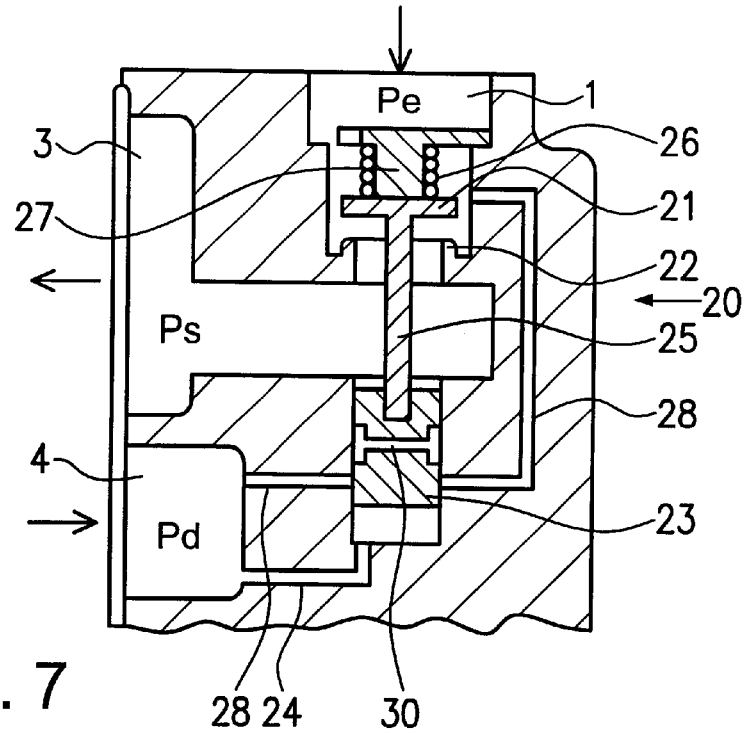
Figure 8:
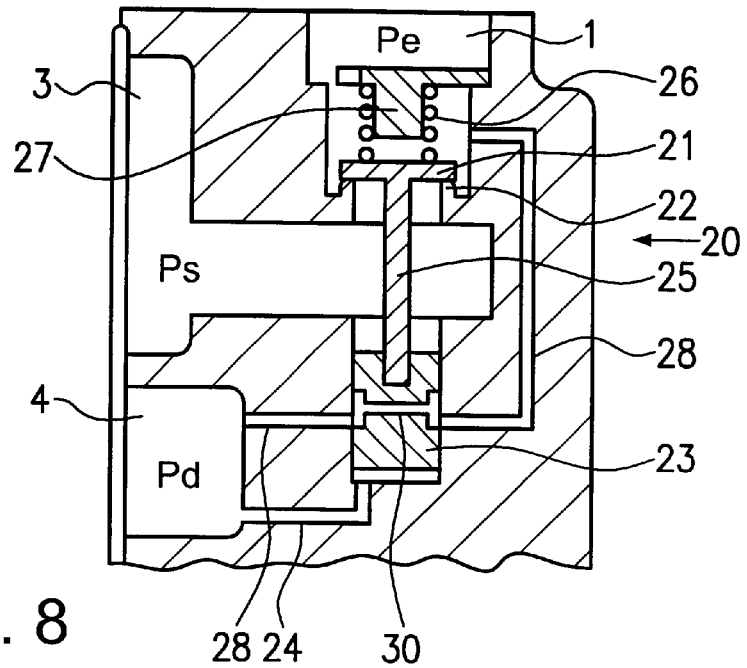

In the embodiment of FIGS. 7 and 8 the valve structure 20 includes the refrigerant reflux conduit 28 separately provided without using the connecting rod 25, Conduit 28 instead extends from discharge chamber 4 laterally into the driving chamber of piston body 23 and continues laterally from said driving chamber to low-pressure pipe conduit 1. Piston body 23 functions as a control piston slide for either opening or closing conduit 28, depending on the stroke position of piston body 23. Conduit 28 exclusively is open when piston body 23 is in a stroke position corresponding to the fully closed state of main valve 21, 22.

Figure 9:
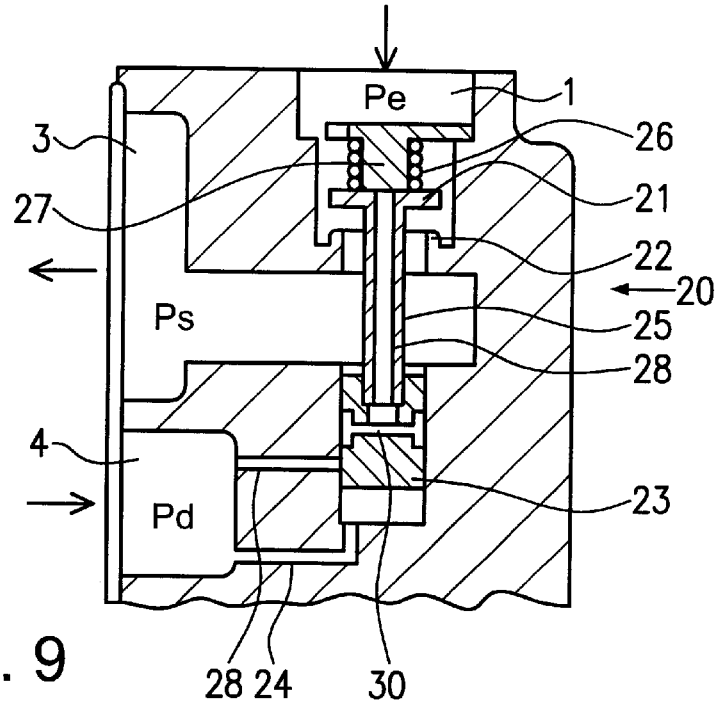
Figure 10:
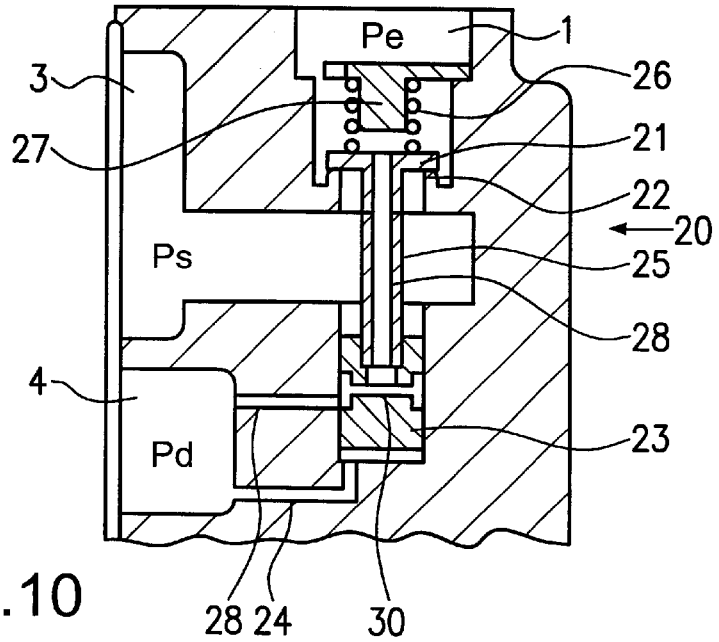

In the embodiment of FIGS. 9 and 10 of the valve structure 20 the refrigerant reflux conduit 28 is provided inside connecting rod 25. Similar as in FIGS. 7 and 8 piston body 23 has the function of a control piston slide opening conduit 28 exclusively in a stroke position corresponding to the closed state of main valve 21, 22. As soon as main valve 21, 22 is in its open state, piston body 28 is blocking conduit 28.

Figure 11:
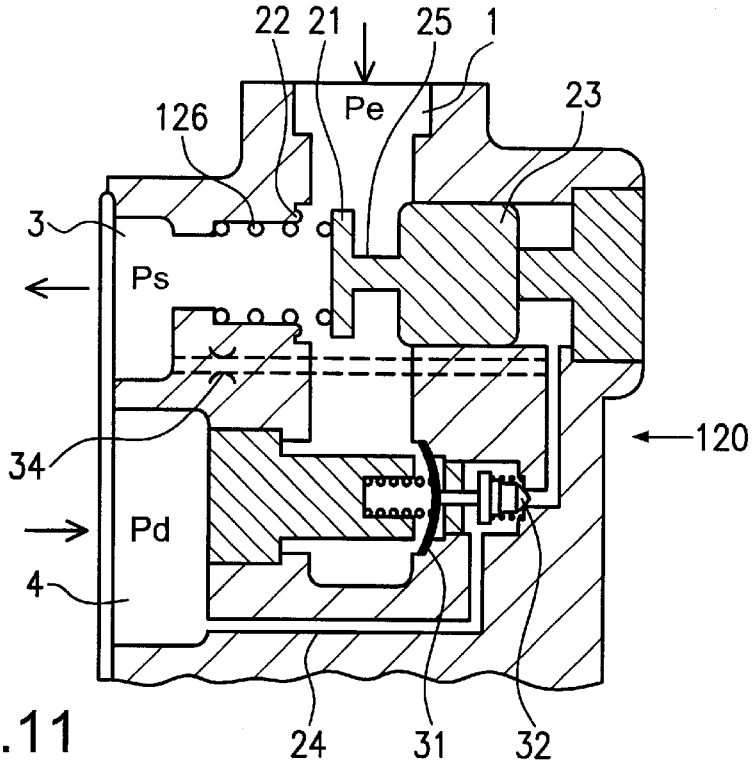
Figure 12:
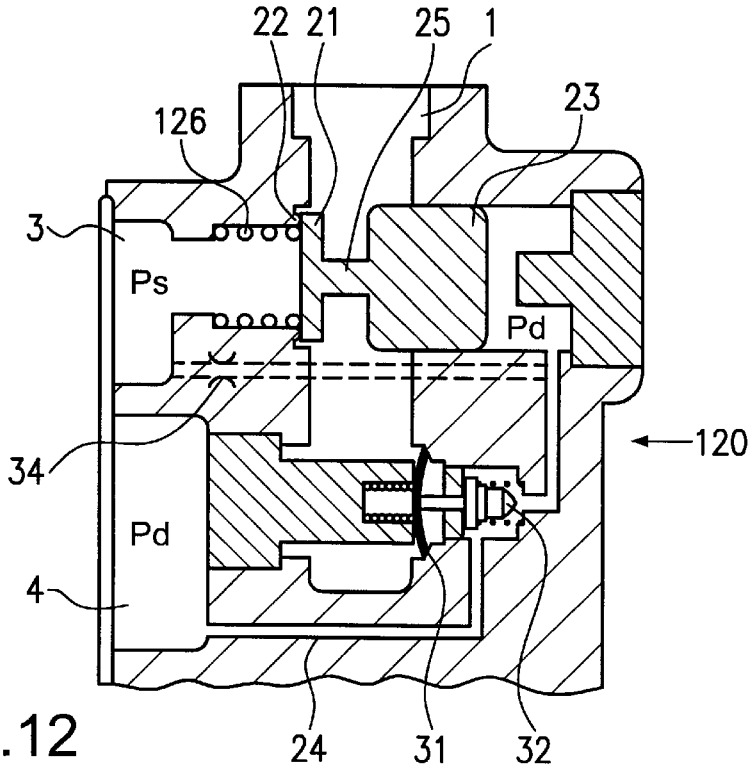

In the embodiment of the valve structure 120 if FIGS. 11 and 12 a temperature sensing open and close valve is used as the main valve for low-pressure refrigerant. In valve structure 120 closure member 21 structurally is connected to piston body 23 by connecting rod 25. Closure member 21 biased by a weak compression spring 126 constituting a main valve opening spring. Pressure Pd in the discharge chamber 4 acts via driving high-pressure side pipe 24 on the rear side of piston body 23 situated in its driving chamber. In this embodiment, however, the pressure Ps in the suction chamber 3 is acting on closure member 21 in opening direction of main valve 21, 22, while pressure Pe in the low-pressure refrigerant pipe conduit 1 is cancelled or is balanced for both closure member 21 and piston body 23. The spring force of compression coil spring 126 (main valve opening spring) is very weak compared with the force of compression coil spring 26 of the preceding embodiments. Compression coil spring 126 does not have force enough to overcome the differential pressure (Pd minus Ps).

In the extension of the driving pipe 24 a high-pressure pipe open and close valve 32 is installed which is connected to a temperature responsive driving member, e.g. a bimetallic member 31, sensing the temperature of the refrigerant in the low-pressure refrigerant pipe conduit 1. Bimetallic member 31 is pre-loaded by springs in both direction of its flexing displacement. Moreover, a cross channel (shown in dotted lines) connects suction chamber 3 and driving chamber of piston body 23. Said channel contains a leak hole or a flow restrictor 34 having a sectional area which is smaller than that of the driving pipe 24, in order to e.g. relieve the pressure at the back side of the piston body 23 when main valve 21, 22 has to be opened.

When the temperature of the refrigerant in the low-pressure refrigerant pipe conduit 1 is higher than, e.g., 0° C. (when the load is large), the bimetallic member 31 drives valve structure 32 into a closed state (FIG. 11). As a result, the pressure in the driving chamber or at the rear side of piston body 23 becomes the same as pressure Ps in suction chamber 3 due to the equalising influence of the channel with its leak hole 34. Since then the actuating structure consisting of closure member 21 and piston body 23 is pressure balanced the pressure of the refrigerant does not act on main valve 21, 22. Closure member 21 is brought into its open position by compression coil spring 126 so that low-pressure refrigerant pipe conduit 1 and suction chamber 3 fall into a mutually connected state.

When the temperature of the refrigerant in the low-pressure refrigerant pipe conduit 1 is lower than, e.g. 0° C. (when the load is small), the bimetallic member 31 drives the valve structure 32 into its open state (FIG. 12).

As a result, the pressure at the rear side of the piston body 23 is the same as pressure Pe in discharge chamber 4. Then differential pressure Pd minus Ps derived from the pressures in the discharge chamber 4 and the suction chamber 3 is acting on the actuation structure consisting of closure member 25 and piston body 23 such that closure member 21 is pressed against valve seat 22 into the closed state of main valve 21, 22. The passage between the low-pressure refrigerant pipe conduit 1 and the suction chamber 3 falls into a closed state. The already mentioned minimum amount of refrigerant still passes through the main valve 21, 22 even in its closed state.

Figure 13:
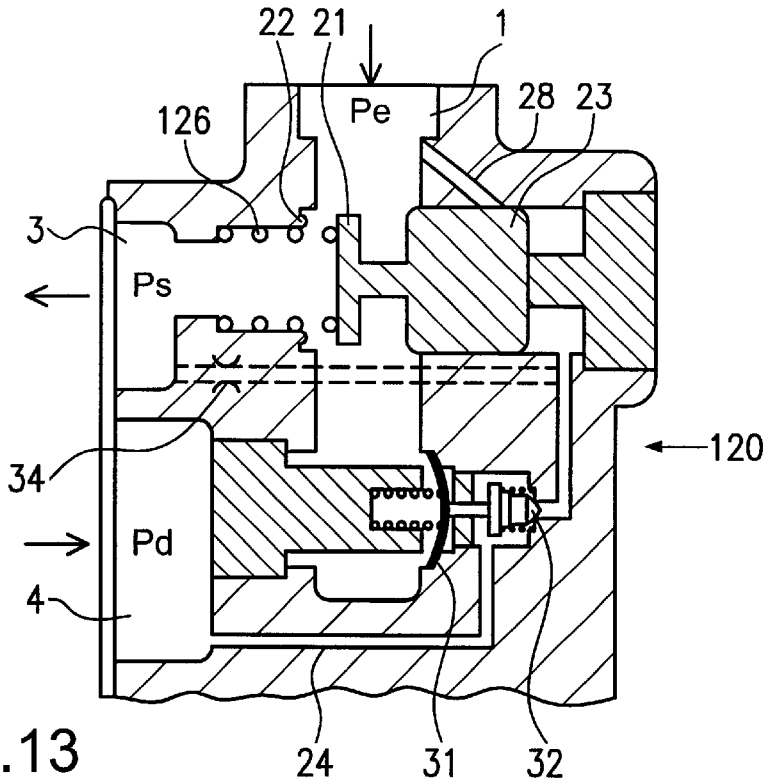
Figure 14:
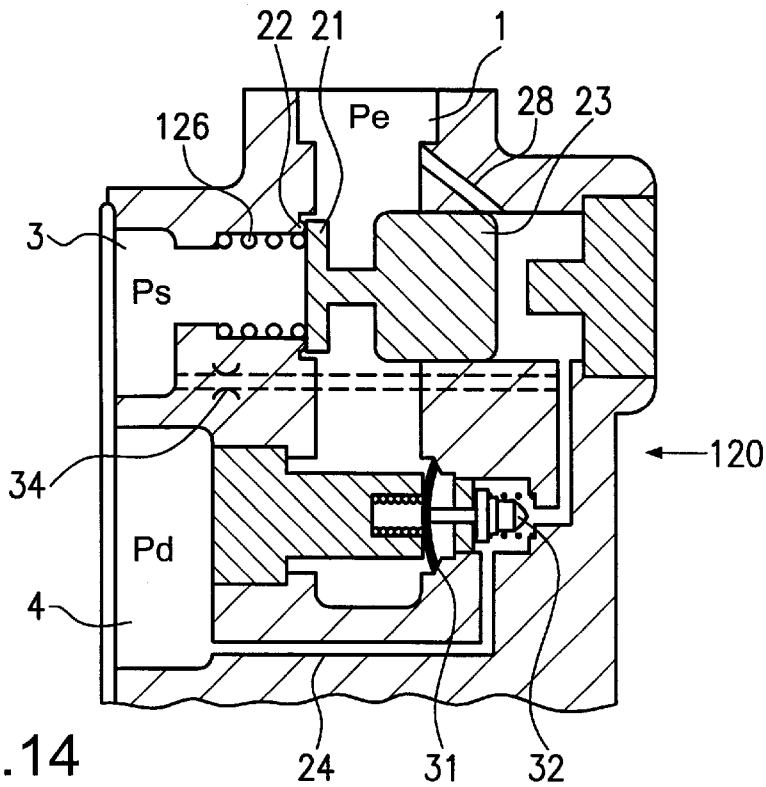

In the embodiment of FIGS. 13 and 14 the refrigerant reflux conduit 28 connects the rear side of the piston body 23 in driving chamber to the low-pressure refrigerant pipe conduit 1. Opening and closing of conduit 28 is controlled by movement of piston body 23 such that conduit 28 is only open when the main valve 21, 22 is in its closed state (when the load is small). In said closed state (FIG. 14), however, the low-pressure refrigerant pipe conduit 1 is connected to the driving pipe 24 via conduit 28 at the same time such that pressure from the discharge chamber 4 is returned to the low-pressure refrigerant pipe conduit 1, e.g., in order to control the pressure in conduit 1.

Figure 15:
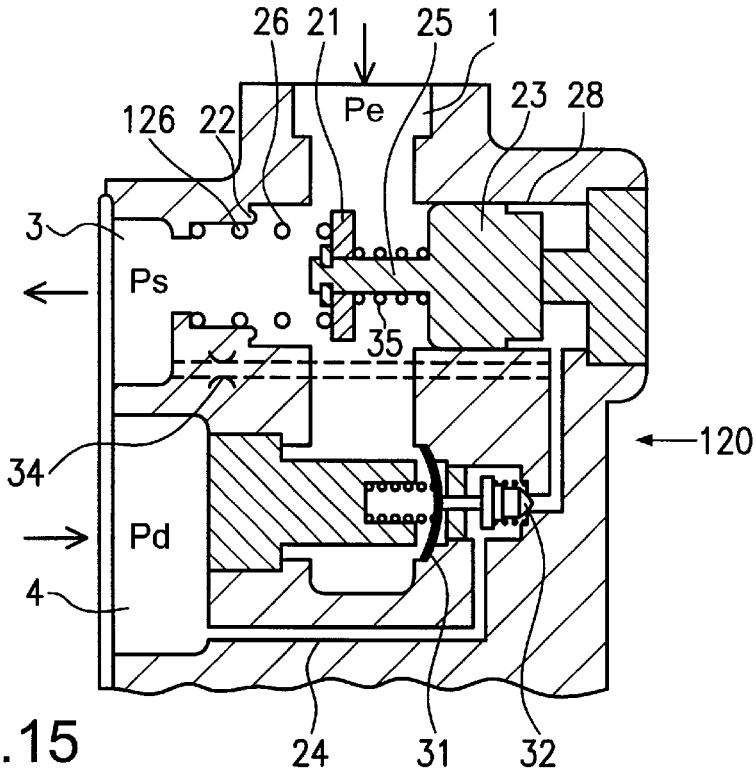
Figure 16:
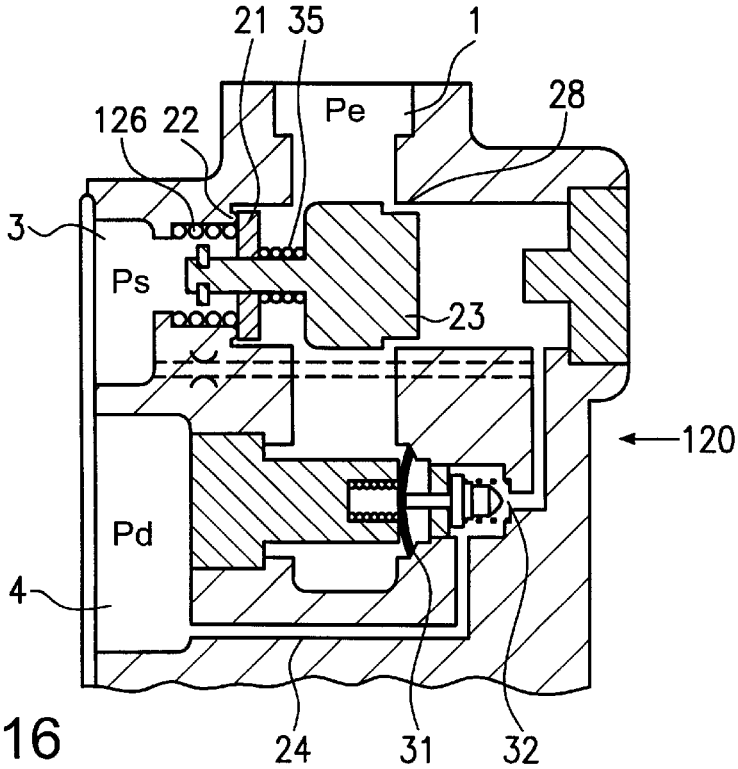

In the embodiment of FIGS. 15 and 16 a temperature sensing open and close valve structure 120 in the refrigerant reflux conduit 28 is formed in a different way. The rear end section of piston body 23 is formed with a cut-out or shoulder co-operating with the inner wall of the driving chamber for piston body 23 such that only in a predetermined stroke position of piston body 23 conduit 28 will be open (in the close state of the main valve 21, 22). As soon as the shoulder or recess of piston body 23 is entering into the driving chamber conduit 28 will be cut off. Closure member 21 in this embodiment slidably is carried by connecting rod 25. Compression coil spring 126 is acting on closure member 21 in opening direction of main valve 21, 22, while simultaneously supplementary spring 35 is loading closure member 21 in the opposite direction towards a stop provided on connecting rod 25. In case of small load, that is the closed state of main valve 21, 22 (FIG. 16), closure member 21 abuts against valve seat 22. Thereafter piston body 23 is moved further by the pressure in its driving chamber until refrigerant reflux conduit 28 is opened and low-pressure refrigerant pipe conduit 1 is connected to driving pipe 24.

Figure 17:
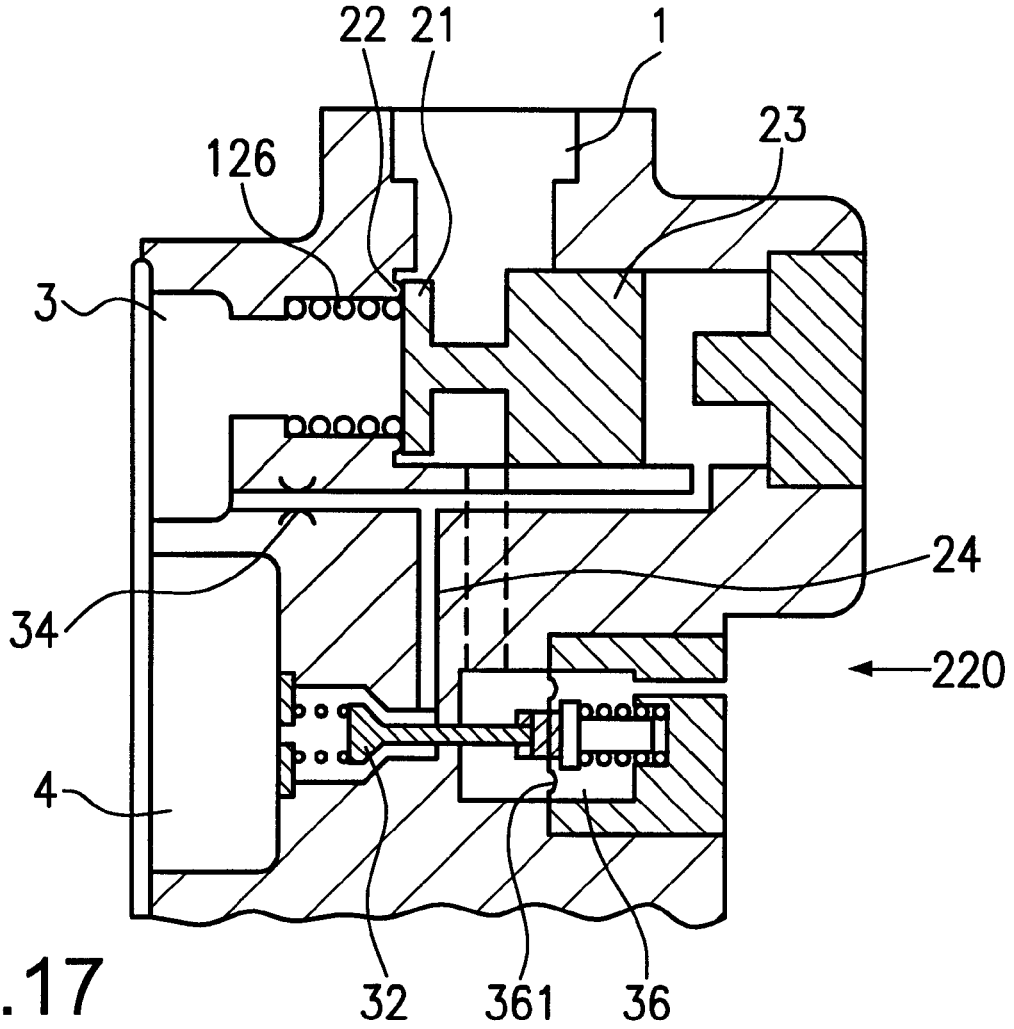

In the embodiment of FIG. 17 main valve 21, 22 is integrated into a pressure sensing open and close valve 220 for low-pressure refrigerant. A valve structure 36 including valve 32 is provided in driving pipe 24 or at its inlet region in discharge chamber 4. Said valve structure 36 is connected with a pressure responsive driving member like a diaphragm 361 hermetically sealing a chamber connected to low-pressure pipe conduit 1 from atmospheric pressure or a reference pressure. Diaphragm 361 senses the pressure in the low-pressure conduit pipe 1 in closing direction of valve structure 36 and is effected by the atmospheric pressure in the opposite direction. Compression springs, acting on both sides of diaphragm 361 maintain the diaphragm 361 in a predetermined position and determine the pressure value at which diaphragm 361 starts to bring valve structure 36 into its closed state. A corresponding setting or adjustment of the valve structure 36 allows to open the main valve 21, 22 automatically when the load is large and to close it when the load is small, depending on a change of the pressure in the low-pressure refrigerant pipe conduit 1. As long as in a condition of large load the pressure Pe in low-pressure conduit pipe 1 is relatively high, diaphragm 361 holds valve structure 36 in its closed state. Driving pipe 24 is blocked. Via restrictor 34 the pressure in the driving chamber of the piston body 23 corresponds to Ps. The weak force of spring 126 adjusts main valve 21, 22 in its open state. In case of low load and relatively low pressure Pe diaphragm 361 is opening valve structure 36 (as shown). Driving line 24 is then connected to discharge chamber 4 so that piston body 23 will be displaced to the left closing main valve 21, 22 in a small load condition (as shown).

The expression "small load or when the load is low as in winter time" means that the "cooling demand" for the refrigerant cycle is reduced due to low ambient temperature in this season. This further means that the "thermal Load" for the air conditioning system also will be reduced.

What is claimed is:

1. A variable displacement compressor (10), comprising an airtight crank chamber (12) and a variable inclination angle swing body (14) installed on an axis (11) of rotation inside said crank chamber (12), at least one piston (17) reciprocally guided in a cylinder (15) and connected to said swing body, said cylinder (15) being selectively connectable to a suction chamber (3) in turn connected to a low-pressure refrigerant pipe conduit (1) or to a discharge chamber (4) in turn connected to a high-pressure refrigerant pipe conduit (2), and means in said variable displacement compressor (10) for varying the amount of discharge of said refrigerant into said discharge chamber (4) between a minimum discharge amount in a minimum operation state of the compressor and a maximum discharge amount by varying the angle of inclination of said swing body corresponding to a change of a pressure (Pc) within said crank chamber, and further comprising a main valve (21, 22) between said low-pressure refrigerant pipe conduit (1) and said suction chamber (3), said main valve being actuable between a fully closed state and a fully opened state, wherein a main valve actuating structure (23, 24, 32, 36) is provided actuating said main valve by refrigerant pressure into its closed state, said main valve actuating structure being responsive to a relative pressure condition or a relative temperature condition of the refrigerant in the low-pressure pipe conduit (1), which relative pressure condition or relative temperature condition in said minimum operation state of said compressor (10) is representing a small load condition.

2. A variable displacement compressor (10), comprising an airtight crank chamber (12) and a variable inclination angle swing body (14) installed on an axis (11) of rotation inside said crank chamber (12), at least one piston (17) reciprocally guided in a cylinder (15) and connected to said swing body, said cylinder (15) being selectively connectable to a suction chamber (3) in turn connected to a low-pressure refrigerant pipe conduit (1) or to a discharge chamber (4) in turn connected to a high-pressure refrigerant pipe conduit (2), and means in said variable displacement compressor (10) for varying the amount of discharge of said refrigerant into said discharge chamber (4) between a minimum discharge amount in a minimum operation state of the compressor and a maximum discharge amount by varying the angle of inclination of said swing body corresponding to a change of a pressure (Pc) within said crank chamber, and further comprising a main valve (21, 22) between said low-pressure refrigerant pipe conduit (1) and said suction chamber (3), said main valve being actuable between a fully closed state and a fully opened state, wherein as said main valve a differential-pressure sensing open and close valve (21, 22, 23, 24) is provided which opens and closes respectively when a differential pressure (Pd) minus (Pe) between the pressure (Pd) of the refrigerant in said discharge chamber (4) and the pressure of the refrigerant in said low-pressure refrigerant pipe conduit (1) is larger or smaller than a predetermined differential pressure value.

3. A variable displacement compressor (10), comprising an airtight crank chamber (12) and a variable inclination angle swing body (14) installed on an axis (11) of rotation inside said crank chamber (12), at least one piston (17) reciprocally guided in a cylinder (15) and connected to said swing body, said cylinder (15) being selectively connectable to a suction chamber (3) in turn connected to a low-pressure refrigerant pipe conduit (1) or to a discharge chamber (4) in turn connected to a high-pressure refrigerant pipe conduit (2), and means in said variable displacement compressor (10) for varying the amount of discharge of said refrigerant into said discharge chamber (4) between a minimum discharge amount in a minimum operation state of the compressor and a maximum discharge amount by varying the angle of inclination of said swing body corresponding to a change of a pressure (Pc) within said crank chamber, and further comprising a main valve (21, 22) between said low-pressure refrigerant pipe conduit (1) and said suction chamber (3), said main valve being actuable between a fully closed state and a fully opened state, wherein as said main valve a temperature sensing open and close valve (21, 22, 23, 24, 32) for low-pressure refrigerant is provided between said low-pressure refrigerant pipe conduit (1) and said suction chamber (3) which opens and closes respectively when the temperature of the refrigerant in said suction chamber (3) and/or said low-pressure pipe conduit (1) is higher or lower than a predetermined temperature value.

4. A variable displacement compressor (10), comprising an airtight crank chamber (12) and a variable inclination angle swing body (14) installed on an axis (11) of rotation inside said crank chamber (12), at least one piston (17) reciprocally guided in a cylinder (15) and connected to said swing body, said cylinder (15) being selectively connectable to a suction chamber (3) in turn connected to a low-pressure refrigerant pipe conduit (1) or to a discharge chamber (4) in turn connected to a high-pressure refrigerant pipe conduit (2), and means in said variable displacement compressor (10) for varying the amount of discharge of said refrigerant into said discharge chamber (4) between a minimum discharge amount in a minimum operation state of the compressor and a maximum discharge amount by varying the angle of inclination of said swing body corresponding to a change of a pressure (Pc) within said crank chamber, and further comprising a main valve (21, 22) between said low-pressure refrigerant pipe conduit (1) and said suction chamber (3), said main valve being actuable between a fully closed state and a fully opened state, wherein as said main valve a pressure sensing open and close valve (21, 22, 23, 24, 36) for low-pressure refrigerant is provided between said low-pressure refrigerant pipe conduit (1) and said suction chamber (3) which opens and closes respectively when the pressure of the refrigerant in said low-pressure refrigerant pipe conduit (1) is lower or higher than a predetermined pressure value.

5. A variable displacement compressor as in claim 1, wherein a refrigerant reflux conduit (28) connects said discharge chamber (4) and said low-pressure refrigerant pipe conduit (1) exclusively when said main valve (21, 22) is separating said low-pressure refrigerant pipe conduit (1) and said suction chamber (3), said refrigerant reflux conduit having a small cross-sectional area.

6. A variable displacement compressor as in claim 1, wherein the main valve (21, 22) comprises a valve seat (22) situated between said suction chamber (3) and said low-pressure conduit pipe (1), a closure member (21) arranged at the side of said valve seat (22) facing the low-pressure pipe conduit (1), and an actuating piston member (23) connected to said closure member (21) and situated in a driving chamber communicating via a driving line (24) with said discharge chamber (4), said closure member (21) and said actuating piston member (23) constituting said main valve displacement structure.

7. A variable displacement compressor as in claim 6, wherein said main valve displacement structure is pressure balanced with respect either to said pressure (Pe) or to said pressure (Ps).

8. A variable displacement compressor as in claim 1, wherein the relative pressure condition is a differential pressure (Pd) minus (Pe) derived from the pressure (Pd) within said discharge chamber (4) and the pressure (Pe) within said low-pressure conduit pipe (1), said differential pressure actuating said main valve (21, 22, 23, 24) in closing direction and in parallel to the force of a main valve closing spring (26).

9. A variable displacement compressor as in claim 1, wherein the relative pressure condition is a differential pressure (Pd) minus (Ps) derived from the pressure (Pd) in said discharge chamber (4) and said pressure (Ps) in said suction chamber (3), said differential pressure actuating said main valve (21, 22) in closing direction and counter to the force of a main valve opening spring (126).

10. A variable displacement compressor as in claim 6, wherein a refrigerant reflux conduit (28) connects said driving chamber and said low-pressure pipe conduit (1), and wherein a valve structure (29, 30) is provided in said refrigerant reflux conduit (28), said valve structure being in an open state in a stroke position of said piston member (23) corresponding to the closed state of said main valve (21, 22).

11. A variable displacement compressor as in claim 6, wherein said driving line (24) receives a valve structure (32) connected to a temperature responsive drive member (31), said temperature responsive drive member (31) being contacted by the refrigerant in said low-pressure pipe conduit (1) to maintain said valve structure in an open state when the temperature of the refrigerant in the low-pressure pipe conduit (1) remains below a temperature value representing a small load condition and to maintain it in a closed state when the temperature of the refrigerant in the low-pressure pipe conduit (1) remains above a temperature value representing a large load condition.

12. A variable displacement compressor as in claim 11, wherein said temperature responsive drive member (31) is a flexible bimetallic drive member which is spring loaded in both flexing directions.

13. A variable displacement compressor as in claim 6, wherein said driving line (24) receives a valve structure (36) connected to a pressure responsive drive member (361), said pressure responsive drive member being situated in the refrigerant in said low-pressure pipe conduit (1) to maintain said valve structure (36, 32) in an open state when the pressure of the refrigerant in said low-pressure pipe conduit (1) remains below a pressure value representing a small load condition and to maintain it in a closed state when the pressure in said refrigerant in the low-pressure pipe conduit (1) represents a large load condition.

14. A variable displacement compressor as in claim 13, wherein said pressure responsive drive member is a diaphragm one side of which is contacted in closing direction of said valve structure (36) by the refrigerant pressure (Pe) in low-pressure pipe conduit (1), the other side of which is contacted by a reference pressure like the atmospheric pressure.

15. A variable displacement compressor as in claim 9, wherein a bleeding channel connects said suction chamber (3) and said driving chamber, said bleeding channel containing a flow restrictor (34) of smaller cross-sectional area than the cross-sectional area of said driving line (24).

16. A variable displacement compressor as in claim 9, wherein a refrigerant reflux conduit (28) connects said driving chamber and said low-pressure pipe conduit (1), and wherein said reflux conduit (28) is blocked in the open state of the main valve (21, 22) and is open in the closed state of said main valve.

* * * * *